US006715254B2

(12) United States Patent
Regular

(10) Patent No.: US 6,715,254 B2
(45) Date of Patent: Apr. 6, 2004

(54) ROOF JACK SYSTEM

(76) Inventor: Gordon Regular, 4 Lawndale Road, Toronto, Ontario (CA), M1M 3R6

( * ) Notice: Subject to any disclaimer, the term of this patent is extended or adjusted under 35 U.S.C. 154(b) by 24 days.

(21) Appl. No.: 09/992,754

(22) Filed: Nov. 14, 2001

(65) Prior Publication Data

US 2002/0056246 A1 May 16, 2002

Related U.S. Application Data

(60) Provisional application No. 60/248,928, filed on Nov. 15, 2000.

(51) Int. Cl.[7] ..... E04B 1/32
(52) U.S. Cl. ..... 52/639; 52/127.2; 52/24
(58) Field of Search ..... 182/45, 113; 52/127.2, 52/24, 639

(56) References Cited

U.S. PATENT DOCUMENTS

| | | | | | |
|---|---|---|---|---|---|
| 232,556 | A | * | 9/1880 | Silvius | 182/45 |
| 429,427 | A | * | 6/1890 | Dearborn | 182/45 |
| 1,172,227 | A | * | 2/1916 | Schade | 248/237 |
| 1,255,692 | A | * | 2/1918 | Bearden | 248/237 |
| 1,917,809 | A | * | 7/1933 | Reimann | 248/237 |
| 2,329,415 | A | | 9/1943 | Osborne | 304/20 |
| 2,426,825 | A | * | 9/1947 | Geary | 248/237 |
| 2,448,746 | A | | 9/1948 | Sundeen | 304/20 |
| 2,910,135 | A | | 10/1959 | Moore | 182/113 |
| 3,164,353 | A | * | 1/1965 | Rene | 248/237 |
| 3,901,481 | A | | 8/1975 | Probst | 256/59 |
| 4,676,341 | A | | 6/1987 | Shaffstall | 182/45 |
| 5,067,586 | A | | 11/1991 | Myers | 182/45 |
| 5,113,971 | A | * | 5/1992 | Violet | 182/45 |
| 5,318,148 | A | * | 6/1994 | Franco et al. | 182/45 |
| 5,515,941 | A | * | 5/1996 | Palmer et al. | 182/45 |
| 5,518,333 | A | | 5/1996 | Cienkus, Jr. et al. | 403/169 |
| D373,718 | S | * | 9/1996 | Rondeau | D8/349 |
| 5,573,227 | A | * | 11/1996 | Hemauer et al. | 256/65.06 |
| 5,647,451 | A | | 7/1997 | Reichel | 182/45 |
| 5,711,398 | A | | 1/1998 | Bartholomew | 182/45 |
| 5,979,600 | A | | 11/1999 | Bitner | 182/45 |
| 6,003,629 | A | * | 12/1999 | Cloutier et al. | 182/45 |

FOREIGN PATENT DOCUMENTS

| | | | |
|---|---|---|---|
| GB | 2 192 660 A | 1/1988 | E04G/3/12 |

* cited by examiner

*Primary Examiner*—Carl D. Friedman
*Assistant Examiner*—Basil Katcheves
(74) *Attorney, Agent, or Firm*—Mark Kusner; Michael A. Jaffe

(57) ABSTRACT

A roof jack system that provides a safety barrier that is conveniently installed upon and removed from a pitched roof. The roof jack system includes a guard assembly that is releasably attachable to an auxiliary support assembly of a first embodiment of the present invention that is secured to an existing roof jack. Alternatively, the guard assembly is releasably attachable directly to a roof jack according to a second embodiment of the present invention.

8 Claims, 6 Drawing Sheets

ROOF JACK SYSTEM

This application claims the benefits of Provisional Application No. 60/246,928 filed on Nov. 15, 2000.

FIELD OF THE INVENTION

The present invention relates to the field of roofing safety devices, and more particularly, to an improved roof jack system that provides a safety barrier that is easily and conveniently installed upon and removed from a pitched roof.

BACKGROUND OF THE INVENTION

In the prior art, it is known for roofers to use a conventional roof jack system on pitched roofs to assist roofers in standing on the pitched roof during installation of a new roof, and to provide a relatively horizontal platform for holding roofing supplies, such as bundles of shingles, on the pitched roof prior to installing same. A conventional roof jack system for this purpose comprises two or more roof jacks of known construction placed on the pitched roof at substantially the same vertical height, in horizontally spaced relation one from the other, and a platform member, such as a plank, horizontally extending therebetween. Each roof jack has an elongate base member which, in use, is positionable on the pitched roof in parallel relation to the slope thereof, which base member is rigidly, releasably connectable adjacent its upper end portion to the pitched roof by means of nails or the like protruding from the roof, which nails engage open-ended slots, or other openings, in the upper end portion of the base member. A riser member is rigidly connected to a lower portion of the base member, and extends upwardly and outwardly therefrom, in substantially transverse relation to the base member (and to the roof surface). The riser member terminates in an upper extent, which upper extent has mounted thereon a stop member. The stop member extends from the upper extent of the riser member in a substantially vertically directed manner to a free end. A support member is rigidly attached to and extends substantially horizontally between an intermediate portion of the base member and the upper extent of the riser member. In use, the plank is placed between the plurality of roof jacks, so as to extend between and rest atop the support member of each roof jack in substantially parallel relation to the support members. The plank has a lateral dimension (i.e., width) selected to provide for releasable, frictional containment of the plank between the stop member and the base member of each roof jack, which containment prevents lateral horizontal sliding of the plank relative to the support members.

Such prior art roof jack systems have gained widespread acceptance, as they are relatively easy and economical to manufacture, and are easy to assemble and to disassemble upon a pitched roof. Moreover, such prior art roof jack systems are relatively lightweight and robust, making them easy to transport between job sites and difficult to damage in use and in transport.

While the use of such prior art roof jack systems has gained widespread acceptance, and while such use affords a safety advantage to roofers shingling a pitched roof by providing a more secure footing on such a roof for carrying out this dangerous task, it falls short in failing to provide a safety barrier for roofers to fall against or to grab in the event that they should lose their balance or footing while on the roof. Moreover, such a prior art roof jack system fails to provide a debris barrier for blocking or deflecting debris that may slide down the roof during stripping of old roofing materials or during the reshingling operation.

It is, therefore, an object of the present invention to provide a roof jack system that features all of the utility present in prior art roof jack system as described herein, but which is also capable of providing for the releasable mounting of a safety barrier for roofers to fall against or to grab in the event that they should lose their balance or footing while on the roof, thus preventing such roofers from falling to the ground with consequent injury or death.

It is a further object of the present invention to provide a roof jack system that accommodates the releasable mounting of an auxiliary debris barrier for the blocking or deflecting of debris that may accidentally slide down the roof during stripping of old roofing materials or during the reshingling operation, thereby to prevent injury or damage to persons or property adjacent to the job site.

It is yet a further object of the present invention to provide a roof jack system that is suitable for use in conjunction with prior art roof jacks of the general type herein described, thereby allowing users of such prior art systems to readily realize the safety advantages of the present invention whilst minimizing the inertia to change that might otherwise be entailed in having long-time users of such prior art systems adapt to the use of a system that appears, at first blush, to have little or no similarity to the systems of their experience.

It is still a further object of this invention to provide a roof jack system that can be used in conjunction with prior art roof jacks of the general type herein described, thereby allowing existing owners of such prior art roof jacks to realize the benefits of the present invention without having to discard or otherwise discontinue use of their previously purchased roof jacks.

It is yet a further object of this invention to provide a roof jack system that is relatively easy to transport up and down a ladder in disassembled form by a single person, and that is relatively easy to assemble once lifted onto the pitched roof, and to disassemble after use.

It is a further object of the present invention to provide, in an alternate embodiment, a roof jack system according to the present invention that does not require the use of prior art roof jacks. Rather, in such alternate embodiment, the use of conventional roof jacks is avoided by modifications to several of the components disclosed in relation to the first embodiment of the invention, thus obviating the need to separately purchase for use prior art roof jacks of the general type disclosed herein.

SUMMARY OF THE INVENTION

In accordance with a first aspect of the present invention there is disclosed an improved roof jack system for use with prior art roof jacks having a first plurality of roof jacks placed on a pitched roof at substantially the same vertical height, in horizontally spaced relation one from the other, and a platform member, such as a plank, horizontally extending therebetween. Each roof jack of a prior art system has an elongated base member which, in use, is positionable on the pitched roof in parallel relation to the slope thereof, which base member is rigidly, releasably connectable adjacent its upper end portion to the pitched roof by means of nails or the like protruding from the roof, which nails engage open-ended slots, or other openings, in the upper end portion of the base member. A riser member is rigidly connected to a lower end portion of the base member, and extends upwardly and outwardly therefrom, in substantially transverse relation to the base member (and to the roof surface). The riser member terminates in an upper extent, which upper extent has mounted thereon a stop member. The stop member extends from the upper extent of the riser member in a substantially vertically directed manner to a free end. A support member is rigidly attached to and extends substantially horizontally between an intermediate portion of the base member and the upper extent of the riser member. In use, the plank is placed between the first plurality of roof jacks, so as to extend between and rest atop the support member of each roof jack of the first plurality in substantially parallel relation to the support members of each roof jack. The plank has a lateral dimension (i.e., width) selected to provide for releasable, frictional containment of the plank between the stop member and the base member of each roof jack, which containment prevents lateral horizontal sliding of the plank relative to the support members.

The improved roof jack system of the present invention comprises a barrier member having a guard assembly that is releasable connected with each of the prior art roof jacks, such that the guard assembly is operatively positioned, in use, above the level of the plank to prevent a roofer from falling past the guard assembly in the event of losing his/her footing on the plank.

In accordance with a first embodiment of the present invention, the barrier member comprises a guard assembly having at least two parallel vertical support posts rigidly connected to one another by one or more horizontal transverse rails. The barrier member further comprises at least two auxiliary support assemblies, each auxiliary support assembly comprising a main body having defined therewithin a substantially upwardly-opening channel, said channel being, in use, positioned for releasably constrained receipt of a riser member of a respective one of the roof jacks. Each auxiliary support assembly also comprising a substantially planar base plate rigidly connected adjacent a lower end of the main body. In use, the base plate is frictionally constrained between and by the base member of said respective one of the roof jacks and the roof. A brace member rigidly extends across the top of said upwardly opening channel in displaced relation from the lower end of each main body, which brace portion is, in use, in encircling receipt of the stop member of a respective one of the first plurality of roof jacks. A respective pin operatively rigidly extends from the upper end of the main body for operative connection with sockets of the vertical support posts. Each pin is dimensioned and otherwise adapted for releasable, interfitting frictional engagement within the socket.

In accordance with a second embodiment of the invention, conventional roof jacks are not required, as the functional features of conventional roof jacks, and of the barrier member, are combined in a modified form of a non-conventional roof jack, thereby eliminating the need for conventional roof jacks.

Other advantages, features and characteristics of the present invention, as well as methods of operation and functions of the related elements of the structure, and the combination of parts and economies of manufacture, will become more apparent upon consideration of the following detailed description, with reference to the accompanying drawings, the latter of which are briefly described hereinbelow.

BRIEF DESCRIPTION OF THE DRAWINGS

The novel features which are believed to be characteristic of the present invention, as to its structure, organization, use and method of operation, will be better understood from the accompanying drawings in which both a first and an alternative embodiment of the present invention are shown. It is expressly understood, however, that the drawings and written description are for the purpose of illustration only, and are not intended as a definition of the limits of the invention. In the accompanying drawings.

DETAILED DESCRIPTION OF PREFERRED EMBODIMENTS

Figure 1:
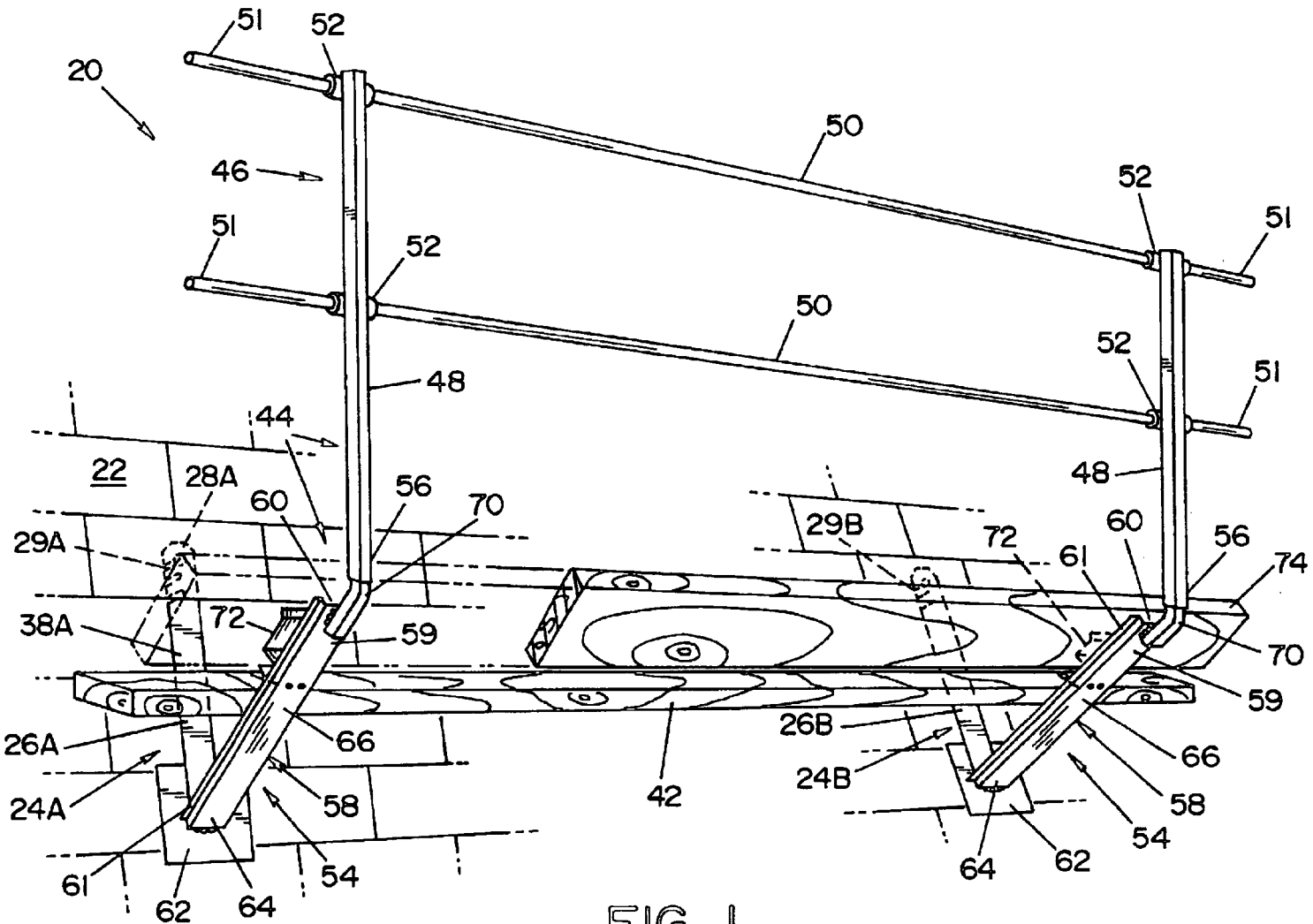
FIG. 1 is a perspective view of an assembled roof jack system mounted to a roof, in accordance with a first embodiment of the present invention.

Referring now to the drawings wherein the showings are for the purpose of illustrating preferred embodiments of the invention only, and not for the purpose of limiting same, FIGS. 1–8 illustrate a roof jack system 20 according to a first embodiment of the present invention. Referring now to FIG. 1, there is shown an assembled roof jack system 20, as mounted to a pitched roof 22. Roof jack system 20 is adapted for use with components of an existing prior art roof jack system, as will be described below. Roof jack system 20 is generally comprised of at least two roof jacks 24A, 24B, a platform member 42 (e.g., a 2×10 plank), and a barrier member 44.

In accordance with the first embodiment of the present invention, roof jacks 24A, 24B and a platform member 42 are components comprising existing prior art roof jack systems. A pair of roof jacks 24A, 24B of known construction are arranged on pitched roof 22 at substantially the same vertical height, in horizontally spaced relation to one another. Platform member 42 (e.g., a plank), which is substantially planar and rigid, is placed between the first 24A and second 24B roof jacks to provide a support surface, as will be described further below.

Figure 2:
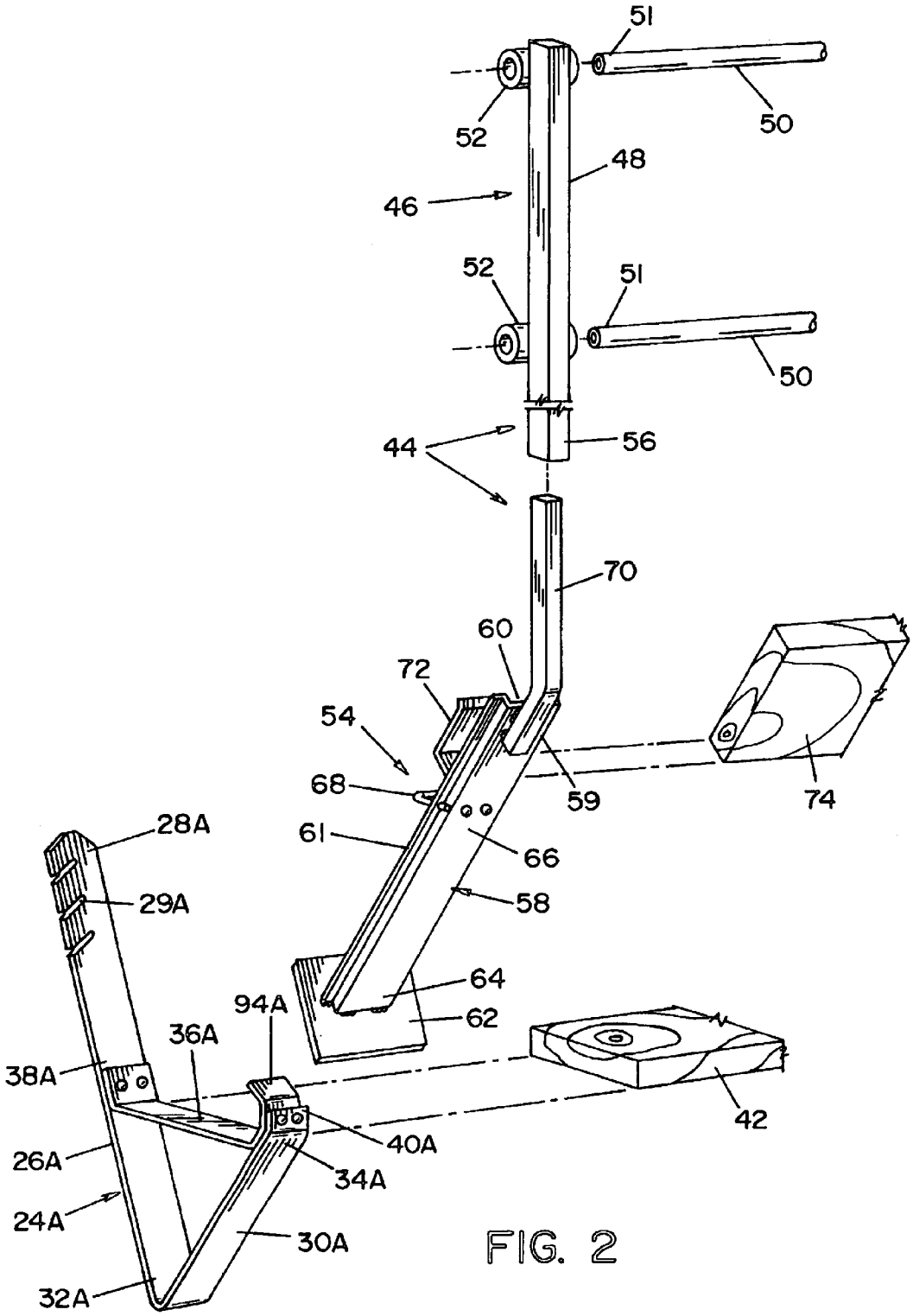
FIG. 2 is a partial exploded view of the roof jack system according to a first embodiment of the present invention.

The first roof jack 24A, best seen in FIG. 2, is generally comprised of an elongated base member 26A, a riser member 30A, and a support member 36A. Base member 26A includes an upper end portion 28A, an intermediate portion 38A, and a lower end portion 32A. As best shown in FIG. 1, base member 26A is positioned on roof 22 in generally parallel relation to the slope of pitched roof 22. Upper end portion 28A of base member 26A is rigidly, releasably connected to the pitched roof 22, by means of nails or other fastening means (obscured by shingles covering the upper end portion 28A in FIG. 1) protruding from roof 22. Nails (not shown) engage open-ended slots 29A, or other openings formed in upper end portion 28A (in the same general manner as is known in the art).

Riser member 30A includes an upper extent 34A, and a rigid stop member 40A. Riser member 30A is rigidly connected to lower end portion 32A of the base member 26A, and extends upwardly and outwardly from the point of such connection, in substantially transverse relation to base member 26A (and to the surface of the pitched roof 22). Stop member 40A includes a free end 94A, and extends from upper extent 34A of riser member 30A in a substantially vertically directed manner to free end 94A.

Support member 36A is rigidly attached to and extends substantially horizontally between an intermediate portion 38A of base member 26A and upper extent 34A of riser member 30A. Support member 36A is also rigidly attached to upper extent 34A.

It should be appreciated that in accordance with a preferred embodiment, second roof jack 24B is identical in all material respects to first roof jack 24A, such that it will not, for the sake of brevity, be separately described in detail; rather, the various structures of second roof jack 24B which are analogous to the structures described above in relation to first roof jack 24A have been assigned the same reference numeral, with the alpha suffix "B" replacing the alpha suffix "A".

As indicated above, platform member 42 is placed between first roof jack 24A and second roof jack 24B. Platform member 42 extends between and rests atop support members 36A of first roof jack 24A and support member 36B of second roof jack 24B, in substantially parallel relation to said support members 36A and 36B. Platform member 42 has a lateral dimensional (width) selected to provide for releasable, frictional containment of the platform member 42 between stop members 40A, 40B and base members 26A, 26B of both roof jacks 24A, 24B. This containment prevents lateral substantially horizontal sliding of platform member 42 relative to support members 36A, 36B.

As discussed above, roof jack system 20 further comprises a barrier member 44 suitable for use in combination with first roof jack 24A, second roof jack 24B, and platform member 42 of an existing prior art roof jack assembly. Barrier member 44 is generally comprised of an auxiliary support assembly 54, a guard assembly 46 and an optional debris barrier 74 (second plank).

Guard assembly 46 provides a safety barrier, and is generally comprised of a plurality of vertical support posts 48 and a plurality of horizontal transverse rails 50, as best seen in FIG. 2. The lower portion of vertical support posts 48 are preferably hollow to provide a socket 56, thus allowing for convenient attachment of guard assembly 46 to auxiliary support assembly 54, as will be described in detail below. A plurality of cylindrical receiving members 52 are attached to support posts 48, and are arranged generally transverse thereto. Receiving members 52 are dimensioned to receive the end section 51 of rails 50 in sliding relation thereto. The end section 51 of rails 50 extend through receiving members 52, as best seen in FIG. 1. In accordance with a preferred embodiment, at least two parallel vertical support posts 48 are connected to each other by one or more horizontal transverse rails 50. However, it should be appreciated that other suitable structures may be substituted for horizontal transverse rail 50, including but not limited to a plurality of vertical bars, fencing material, and mesh fabric.

Auxiliary support assembly 54 is generally comprised of a main body 58, a bottom member 62, a restraining element 68, a pin 70, and a cradle arm 72. Main body 58 preferably takes the form of a generally U-shaped member defining a substantially upwardly-opening channel 60, and having a pair of outward extending lateral flanges 61. Channel 60 is dimensioned to releasably receive riser member 30A, 30B of respective roof jacks 24A, 24B, as best shown FIGS. 3 and 5–7.

Figure 8:
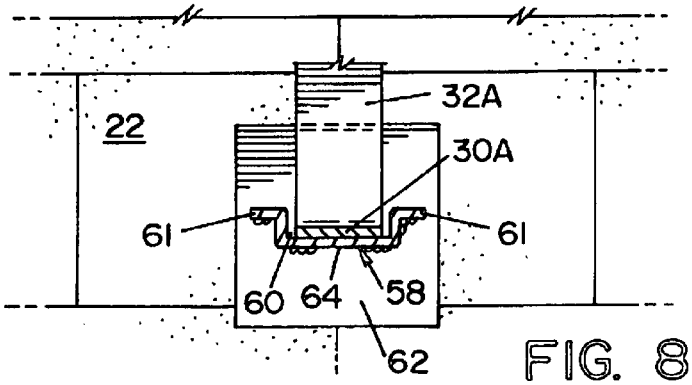
FIG. 8 is a cross-sectional view of the roof jack system taken along line 8—8 of FIG. 8.
Figure 4:
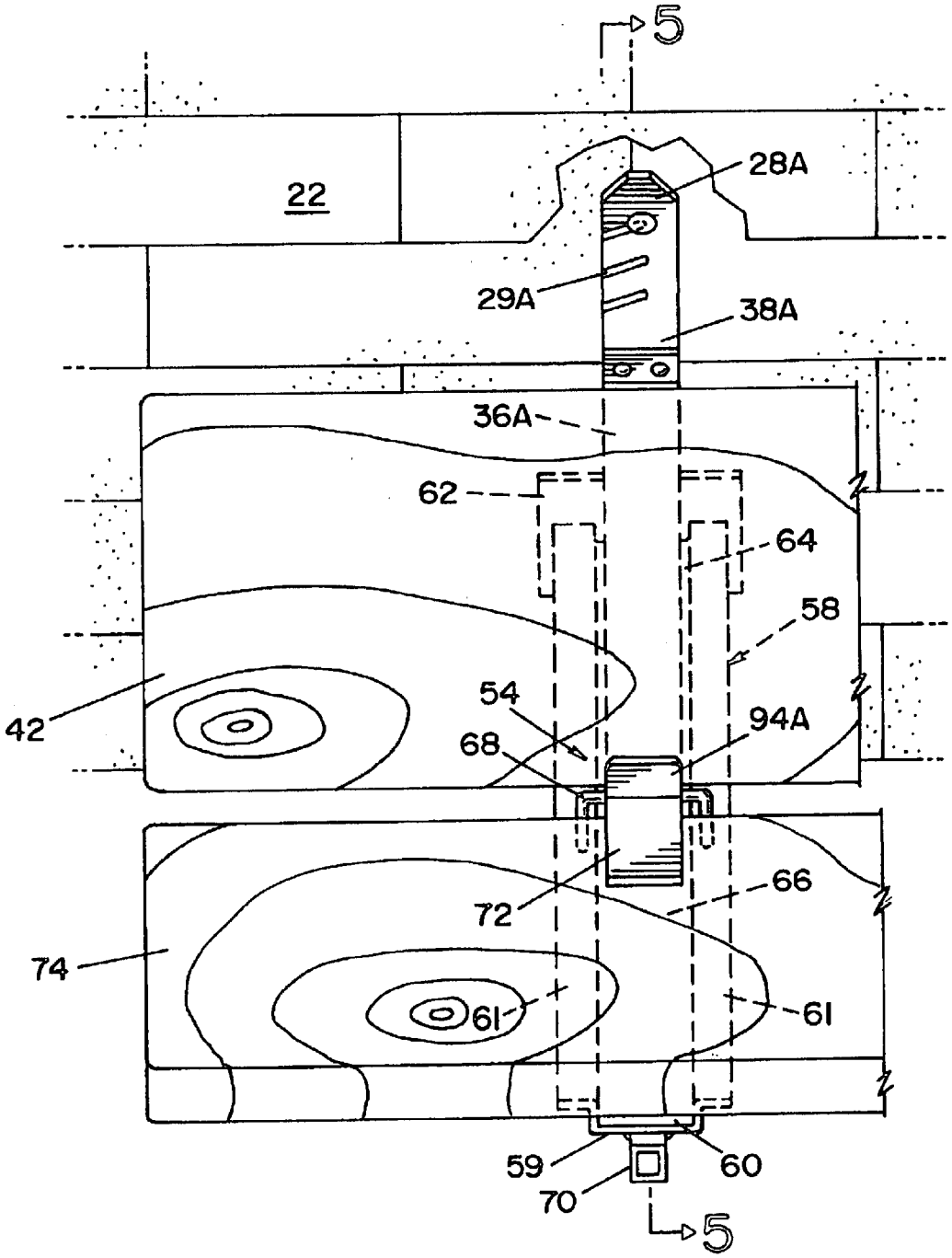
FIG. 4 is a top plan view of a portion of the roof jack system shown in FIG. 1.

Bottom member 62 preferably takes the form of a substantially planar pad or plate that is rigidly connected adjacent to lower end 64 of main body 58, and located transverse to the longitudinal axis of main body 58. In use, bottom member 62 is frictionally secured between and by base members 26A, 26B of respective roof jacks 24A, 24B and pitched roof 22, as best shown in FIGS. 1, 5 and 8.

Figure 3:
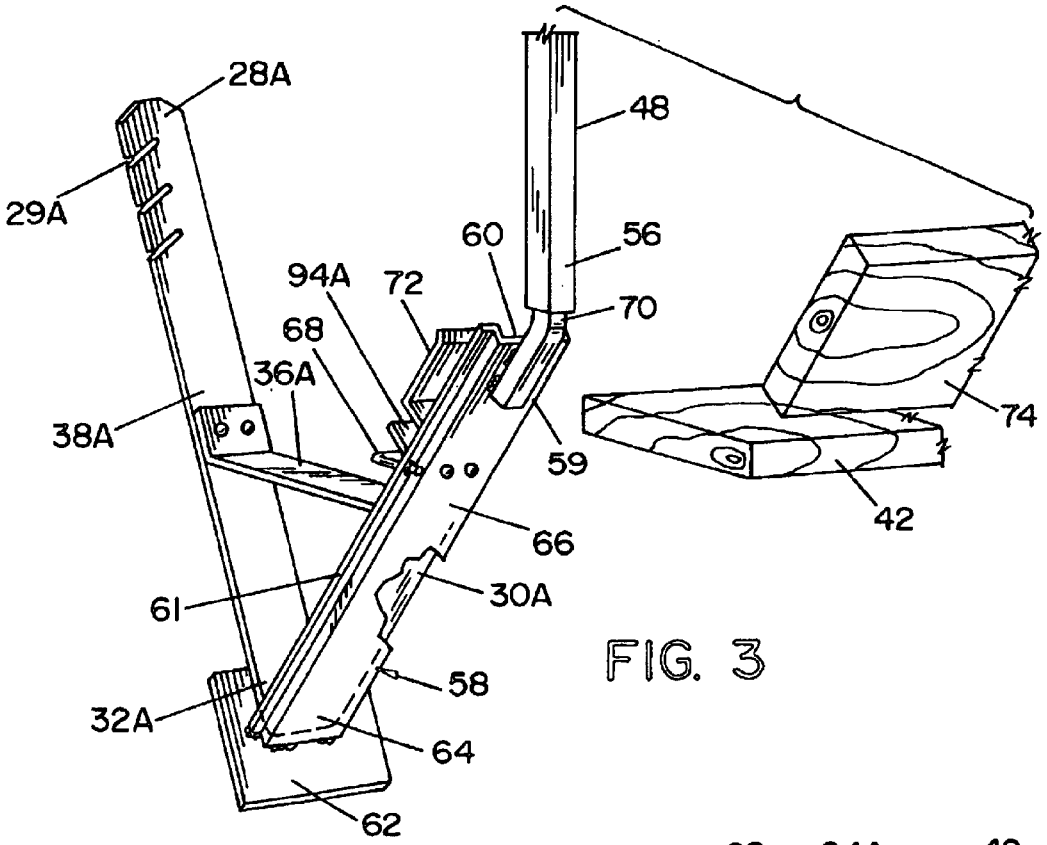
FIG. 3 is a partially assembled perspective view of a portion of the roof jack system shown in FIG. 2.
Figure 6:
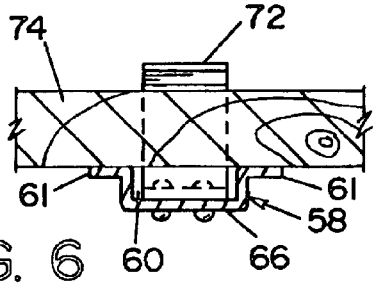
FIG. 6 is a cross-sectional view of the roof jack system taken along line 6—6 of FIG. 5.
Figure 7:
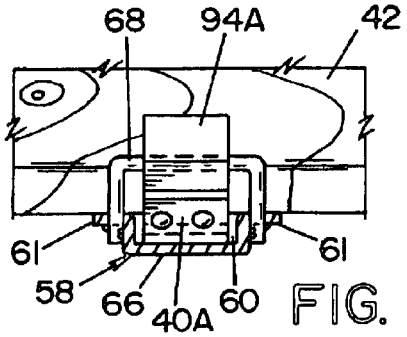
FIG. 7 is a cross-sectional view of the roof jack system taken along line 7—7 of FIG. 5.
Figure 5:
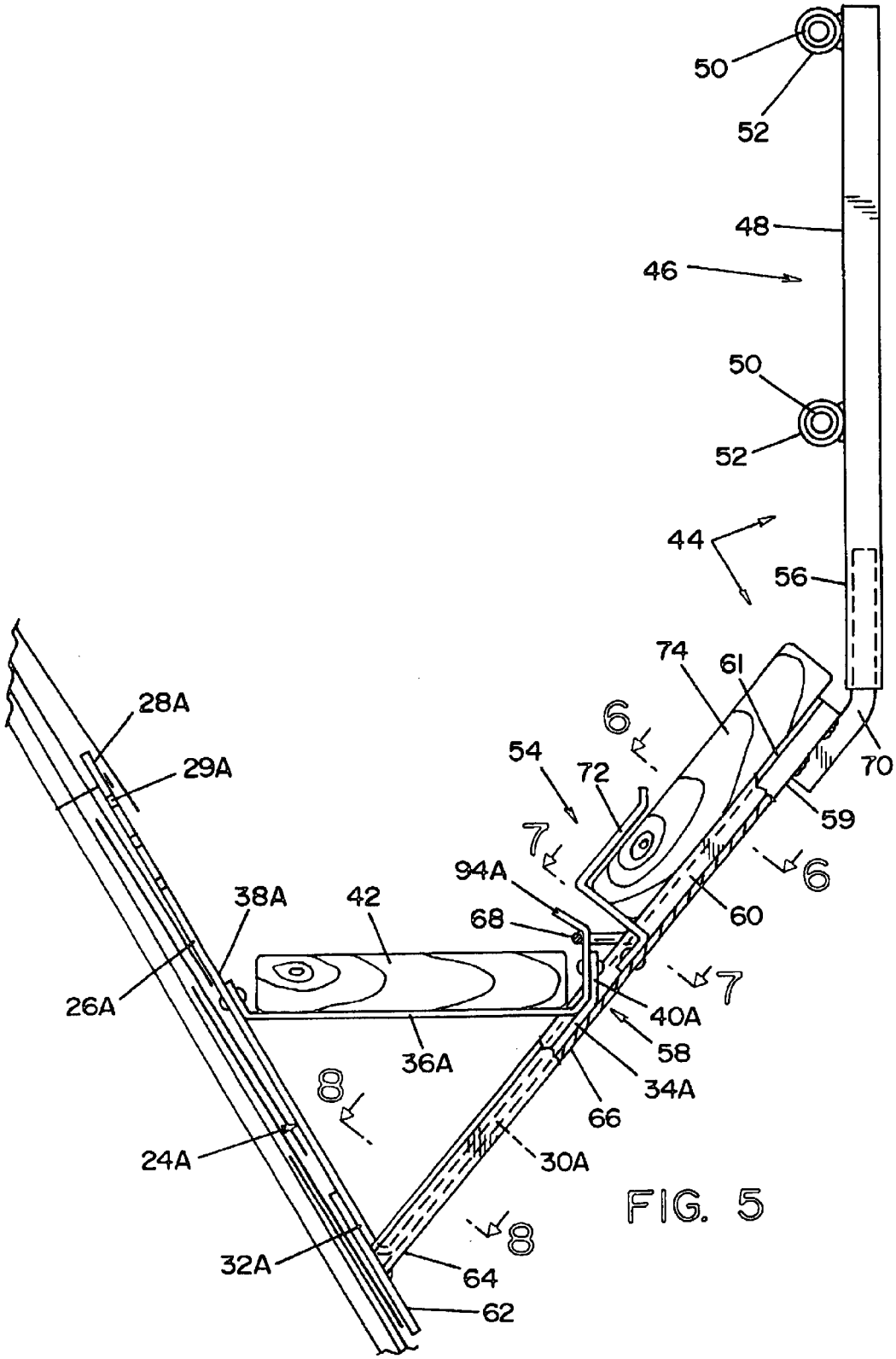
FIG. 5 is a cross-sectional view of the roof jack system taken along line 5—5 of FIG. 4.

Restraining element 68 preferably takes the form of a rigid U-shaped brace extending between flanges 61 in a central section 66 of main body 58, as best seen in FIGS. 3, 5 and 7. In use, restraining element 68 extends across the top of channel 60, so as to be positioned in releasable, encircling receipt of stop member 40A, 40B of respective roof jacks 24A, 24B, as best seen in FIGS. 5 and 7. In this regard, restraining element 68, in conjunction with main body 58, acts as a hook which latches with stop member 40A, 40B to secure auxiliary support assembly 54 to roof jack 24A, 24B. It should be appreciated that restraining element 68 may take many suitable forms, including a brace, as shown in the Figures, as well as a pin member extending across channel 60, and secured in holes formed in the side walls defining channel 60. Main body 58, together with bottom member 62 and restraining element 68, provide a structure that allows auxiliary support assembly 54 to be safely and effectively connected with respective rod jacks 24A, 24B in a readily releasable relation, without the need for hand tools.

Pin 70 preferably takes the form of a cylindrical rod bent at an angle such that the free end of pin 70 extends in a generally vertical direction when auxiliary support assembly 54 is secured to roof jacks 24A, 24B (FIGS. 1 and 3). One end of pin 70 is secured (e.g., via welding) to the upper section 59 of main body 58, as best seen in FIGS. 1–3 and 5. The free end of pin 70 extends in a generally vertical direction, and is dimensioned and otherwise adapted for releasable, interfitting frictional engagement within socket 56 of a respective vertical support post 48. It should be appreciated that socket 56 and pin 70 collectively form connection means for securing guard assembly 46 to auxiliary support assembly 54. It should be appreciated that the connection means may alternatively take the form of a pin associated with vertical support post 48 and a socket associated with auxiliary support assembly 54.

Each auxiliary support assembly 54 optionally includes a respective cradle arm 72. Cradle arm 72 operatively rigidly extends from main body 58 in spaced relation from pin 70, and provides a support surface. A substantially planar debris barrier 74 (e.g., a second plank) is also preferably provided, and is interfitted between cradle arms 72 and pins 70, extending horizontally between each auxiliary support assembly 54. Inclusion of debris barrier 74 is advantageous, in that it assists in the collection of debris which otherwise might fall from a roof to the peril of persons and property beneath.

Barrier member 44 is operatively positioned, in use, above the level of platform member 42 thereby to prevent a roofer from falling past barrier member 44 onto the ground, in the event of losing footing atop platform member 42.

With particular reference to FIGS. 1, 3, 5 and 8, removal and installation of barrier member 44 will be described in detail. Auxiliary support assembly 54 receives riser member 30A of roof jack 24A. Restraining element 68 releasably receives stop member 40B. Pivotal movement of auxiliary support assembly 54 causes riser member 30A to be received (i.e., nested) within channel 60 of main body 58 with bottom member 62 sliding under base member 26A, wherein bottom member 62 becomes frictionally secured between base member 26A and roof 22.

The first embodiment of the present invention, as described above, is advantageous, in that, on large roofs (not shown), it may be desired to install a plurality of conventional prior art roof jacks, for the use of personnel in, inter alia, the transport of materials from position to position upon the roof, and to have the barrier member according to the first embodiment installed only at selected locations, which locations may change periodically. The barrier member is useful and will not unduly hinder the ability of workers to perform their required tasks.

Figure 9:
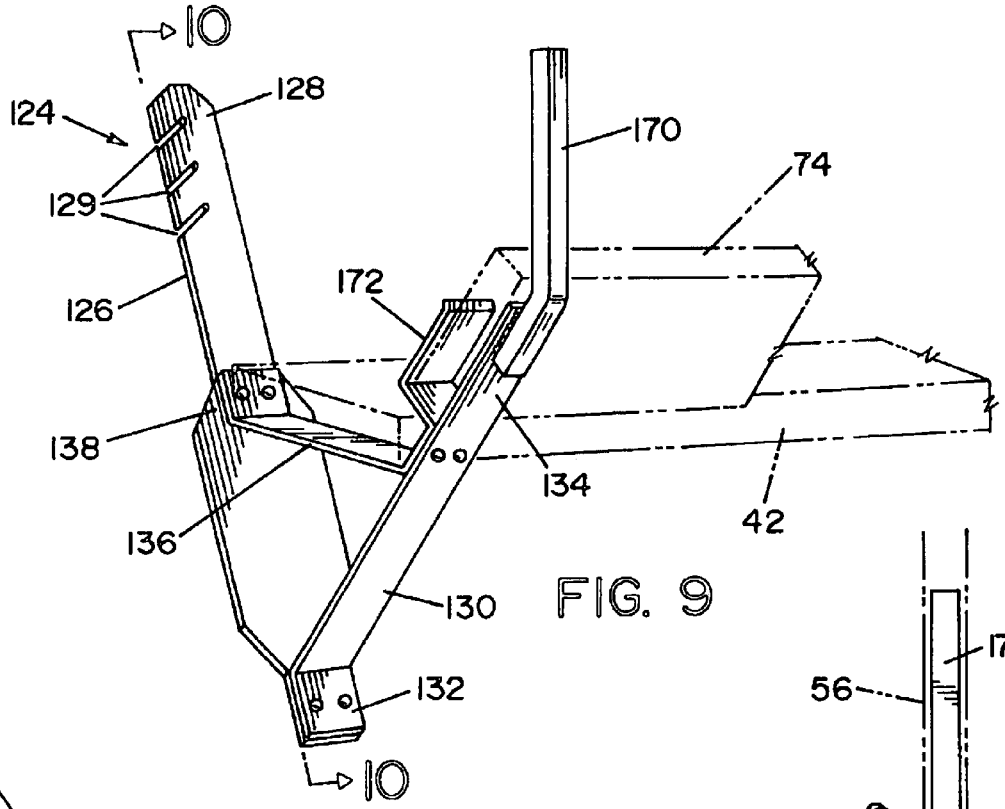
FIG. 9 is a perspective view of a portion of a roof jack system, according to a second embodiment of the present invention.
Figure 10:
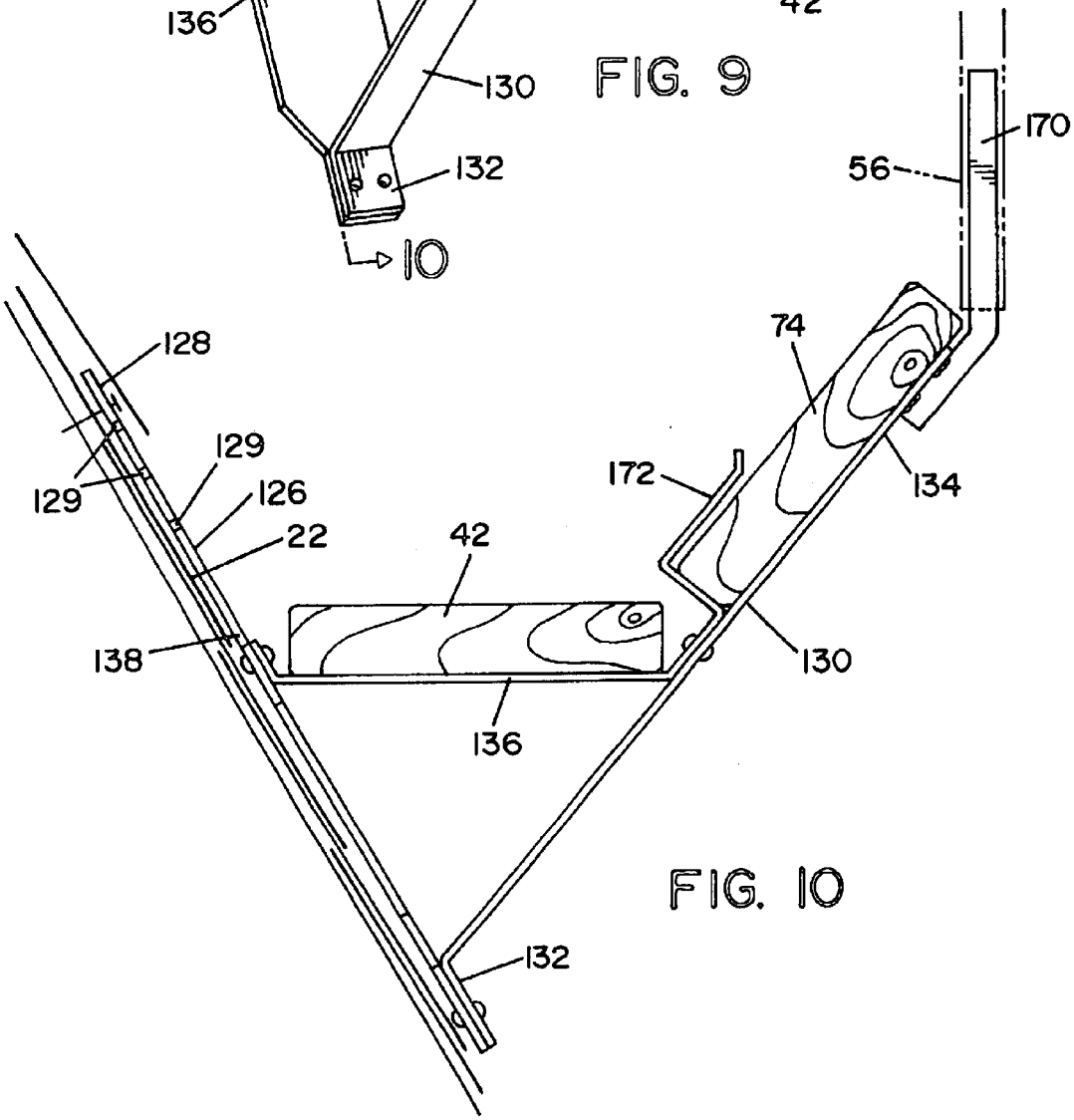
FIG. 10 is a cross-sectional view of the roof jack system according to the second embodiment of the present invention, taken along line 10—10 of FIG. 9.

Referring now to FIGS. 9 and 10, a second embodiment of the present invention will be described. A modified roof jack 124 is provided that combines the functionality of a roof jack 24A and auxiliary support assembly 54 of the first embodiment described above to provide a barrier member, according to an alternative embodiment of the present invention. In this alternative embodiment, modified roof jacks 124 are substituted for roof jacks 24A, 24B and auxiliary support assemblies 54, and are used in conjunction with guard assembly 46. Modified roof jacks 124 thus effectively eliminate the need for utilizing conventional prior art roof jacks to obtain the benefits of a roof jack system according to the present invention.

Modified roof jack 124 is generally comprised of an elongated base member 126, a rigid riser member 130, a support member 136, a pin 170 and an optional cradle arm 172. Base member 126 is positionable upon a pitched roof 22 in generally parallel relation to the pitched roof 22 (FIG. 10). Base member 126 is rigidly, releasably connected, at an upper end portion 128 thereof by fastening means (such as nails) protruding from roof 22. The fastening means (not shown) engage open-ended slots 129 formed in upper end portion 128. Base member is also preferably attached by fastening means (not shown) at a lower end portion 132 thereof.

Riser member 130 is connected to lower end portion 132 of base member 126, and extends upwardly and outwardly from the point of such connection, in substantially transverse relation to base member 126 and to the surface of the pitched roof 22. Riser member 130 terminates at an upper extent 134.

Support member 136 extends horizontally between an intermediate portion 138 of base member 126 and upper extent 134 of riser member 130. Rigid stop member 92 continues upwardly and outwardly from upper extent 134, terminating in a substantially vertically directed cylindrical pin 170. Pin 170 is substantially the same as pin 70. In this regard, pin 170 is shaped and dimensioned for frictionally engaged, releasable, interfitting relation with socket 56 of a respective vertical support post 48, in a manner which is the same in all material respects as pin 70 of the first embodiment described in detail above.

Optional cradle arm 172 operatively rigidly extends from riser member 130 in spaced relation from pin 170. Substantially planar debris barrier 74 is also preferably provided, and is interfitted between cradle arms 172 and pins 170 of respective modified roof jacks 124, in the manner described above in connection with the first embodiment.

It will be evident to persons skilled in the art that modified roof jack 124 of the second embodiment of the present invention can, in use, be disposed on a pitched roof 22 at substantially the same vertical height, in sets of two or more, in horizontally spaced relation one to the other, in combination with a substantially planar platform member 42 extending therebetween and resting upon support members 136 thereof, and in combination with a guard assembly 46. As described in connection with the first embodiment of the present invention, guard assembly 46 includes a pair of parallel vertical support posts 48 rigidly connected to one another by one or more horizontal transverse rails 50, each of the support posts 48 having a respective socket 56. Pins 170 of said pair of modified roof jacks 124 being positioned in frictionally engaged, releasable, interfitting relation with socket 56 of a respective one of vertical support posts 48, thereby to provide, in use, a roof jack system having substantially similar utility to that of the first embodiment of the present invention shown and described herein.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A roof jack system comprising:

a roof jack having a base member adapted to be fastened onto a roof surface and a riser member connected to said base member adapted to project outwardly from a roof surface, said riser member having a free end disposed outwardly from said base member; and an auxiliary support assembly adapted for releasable attachment to said roof jack, said auxiliary support assembly comprised of:

a body portion dimensioned to receive said riser member in nesting fashion, a bottom member adapted to slide under said base member when said riser member is nested in said body portion, wherein said bottom member would be disposed between said base member and a roof surface when said base member is fastened to a roof surface, and a restraining element adapted to capture and hold said riser member in a nested position in said body portion when said bottom member is under said base member.

2. A roof jack system according to claim 1, wherein said restraining element is a brace on said body portion dimensioned to capture said free end of said riser member.

3. A roof jack system according to claim 1, wherein said roof jack system further comprises a guard assembly adapted for attachment to said auxiliary support assembly.

4. A roof jack system according to claim 1, wherein said roof jack system includes at least two said roof jacks and at least two said auxiliary support assemblies.

5. A roof jack system according to claim 4, wherein each said auxiliary support assembly includes a pin secured to said body portion, and a guard assembly including at least two vertical support posts, each said vertical support post including a socket dimensioned to receive a pin from one of said auxiliary support assemblies to releasably secure said guard assembly.

6. A roof jack system according to claim 5, wherein said guard assembly includes at least one transverse rail extending between said at least two vertical support posts.

7. A roof jack system according to claim 1, wherein said auxiliary support assembly further comprises a cradle arm adapted to support a barrier member.

8. A roof jack system according to claim 7, wherein said barrier member is a generally planar plank.

* * * * *